US011267669B2

(12) United States Patent
Malossi et al.

(10) Patent No.: US 11,267,669 B2
(45) Date of Patent: Mar. 8, 2022

(54) METHOD TO REMOVE AN ADHESIVE LABEL FROM A BOBBIN AND APPARATUS TO DETACH AN ADHESIVE LABEL FROM AN END PORTION OF A COILED SHEET IN A BOBBIN

(71) Applicant: PHILIP MORRIS PRODUCTS S.A., Neuchatel (CH)

(72) Inventors: Stefano Malossi, Bologna (IT); Alberto Monzoni, Bologna (IT); Antonella Giannini, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 119 days.

(21) Appl. No.: 16/495,196

(22) PCT Filed: Mar. 21, 2018

(86) PCT No.: PCT/EP2018/057137
§ 371 (c)(1),
(2) Date: Sep. 18, 2019

(87) PCT Pub. No.: WO2018/172400
PCT Pub. Date: Sep. 27, 2018

(65) Prior Publication Data

US 2020/0140218 A1 May 7, 2020

(30) Foreign Application Priority Data

Mar. 22, 2017 (EP) ..... 17162361

(51) Int. Cl.
*B65H 19/10* (2006.01)
*B65H 19/18* (2006.01)

(52) U.S. Cl.
CPC ..... *B65H 19/105* (2013.01); *B65H 2301/414422* (2013.01); *B65H 2301/414436* (2013.01);
(Continued)

(58) Field of Classification Search
CPC ..... B65H 19/105; B65H 2301/4604; B65H 2301/46043; B65H 2301/46044; B65H 2301/51512
See application file for complete search history.

(56) References Cited

U.S. PATENT DOCUMENTS 3,730,454 A 5/1973 Brown
3,767,133 A 10/1973 Komatsu
(Continued)

FOREIGN PATENT DOCUMENTS

CN 1111585 11/1995
CN 1259102 7/2000
(Continued)

OTHER PUBLICATIONS

Office Action issued in China for Application No. 201880005549.6 dated Sep. 3, 2020 (19 pages). English translation included.
(Continued)

*Primary Examiner* — Mark A Osele
(74) *Attorney, Agent, or Firm* — Mueting Raasch Group

(57) ABSTRACT

The present invention relates to a method to remove an adhesive label (22) from a bobbin (28), the bobbin including an end portion (24) and an outer surface (25), the method including: providing a bobbin of a coiled sheet closed by an adhesive label positioned on top of the end portion of the coiled sheet (26) to attach the same to the outer surface of the bobbin; locating the adhesive label; applying a sucking force to the location of the adhesive label so as to detach the adhesive label and the end portion of the coiled sheet from
(Continued)

the bobbin; and cutting a part of the detached end portion including the adhesive label from the bobbin. The present invention also relates to an apparatus to detach an adhesive label from an end portion of a coiled sheet in a bobbin, the adhesive label being located between the end portion and an outer surface of the bobbin.

13 Claims, 10 Drawing Sheets

(52) U.S. Cl.
CPC ..... *B65H 2301/46043* (2013.01); *B65H 2301/46044* (2013.01); *B65H 2301/51512* (2013.01); *B65H 2301/515323* (2013.01); *B65H 2406/3124* (2013.01); *B65H 2406/32231* (2013.01); *B65H 2701/1311* (2013.01)

(56) References Cited

U.S. PATENT DOCUMENTS

| | | | | |
|---|---|---|---|---|
| 4,688,736 | A | 8/1987 | Brinker | |
| 4,995,406 | A | 2/1991 | Da Silva | |
| 5,167,376 | A * | 12/1992 | Boldrini | B65H 19/105 242/562 |
| 5,197,688 | A | 3/1993 | Vaccari | |
| 5,277,731 | A | 1/1994 | Krimsky | |
| 5,518,202 | A | 5/1996 | Focke | |
| 9,162,484 | B2 * | 10/2015 | Hoshino | B65H 35/0086 |
| 2008/0134635 | A1 | 6/2008 | Johnson | |

FOREIGN PATENT DOCUMENTS

| | | | |
|---|---|---|---|
| CN | 101422278 | A | 5/2009 |
| CN | 105398862 | | 3/2016 |
| CN | 106006128 | A | 10/2016 |
| EP | 0189582 | | 8/1986 |
| EP | 0331634 | | 9/1989 |
| EP | 0395024 | | 10/1990 |
| EP | 0 975 542 | | 12/2003 |
| GB | 2037262 | B | 12/1982 |
| JP | 4-327466 | A | 11/1992 |
| JP | H04327466 | | 11/1992 |

OTHER PUBLICATIONS

Office Action issued in China for Application No. 201880005549.6 dated Apr. 15, 2021 (20 pages). English translation included.
PCT Search Report and Written Opinion for PCT/EP2018/057137 dated Jun. 7, 2018 (14 pages).

* cited by examiner

METHOD TO REMOVE AN ADHESIVE LABEL FROM A BOBBIN AND APPARATUS TO DETACH AN ADHESIVE LABEL FROM AN END PORTION OF A COILED SHEET IN A BOBBIN

This application is a U.S. National Stage Application of International Application No. PCT/EP2018/057137 filed Mar. 21, 2018, which was published in English on Sep. 27, 2018, as International Publication No. WO 2018/172400 A1. International Application No. PCT/EP2018/057137 claims priority to European Application No. 17162361.4 filed Mar. 22, 2017.

The present invention is related to a method to remove an adhesive label from a bobbin.

Furthermore, the present invention is related to an apparatus to detach an adhesive label from an end portion of a coiled sheet in a bobbin. In particular, the adhesive label is located between the end portion and an outer surface of the bobbin.

In the fabrication of aerosol generating articles, often materials which are in foil format and delivered in bobbins are used.

Such materials could be a homogenized tobacco material, for instance Tobacco Cast Leaf (TCL), which is dried, and then cut in foils or sheets which are winded up into bobbins for storage and transport. This material, when coiled in bobbins, may be difficult to unwind properly because the TCL may be both sticky, so a rather high force needs to be applied in order to unwind it, and fragile, so that it can be easily torn apart.

Other materials could be for instance Poly Lactic Acid (PLA) which is used to manufacture specific parts of aerosol generating articles' filter.

These bobbins are usually closed with an adhesive label, that is, a sticker, put on a loose end portion of the bobbin, attaching the loose end portion to the outer surface of the bobbin. Information may be often printed on the label, such as information regarding the nature of the material of the sheet and its characteristics, for instance manufacturing time or latest expected date of use.

During the manufacturing process, a specific machine unwinds these bobbins, one at a time, so as to use their sheet or foil to create part of the aerosol generating articles.

In the unwinding part of such machine, a "rotational part" may be provided, usually including a hub connected to an axle-tree. The bobbin may be put on the hub which then may rotate and unwind the bobbin while the foil coming from the bobbin is dragged by specific rollers of the machine.

During manufacturing, bobbins are preferably unwound at a high speed so that the foil coming from the bobbin could be processed with speed usually between about 200 meters per minute and about 400 meters per minute.

In such machines, a sensor (for instance an optical sensor) is usually provided, in particular a "diameter sensor" is provided, which gives information to the machine on the value of the current diameter of the bobbin. This diameter sensor may help to know for instance when the bobbin is almost depleted and has to be replaced. The handling of such bobbin, and specifically the changing of such bobbin, may imply to read the label (so as to make sure that the material of the bobbin is the correct one), then to retrieve the label from the bobbin, to take the loose end portion of a new bobbin and to connect it to a specific part of the manufacturing machine which can afterwards handle it.

Therefore, there is a need of a method and an apparatus for automatically performing these tasks, in particular to automatically remove an adhesive label from an end portion of a coiled sheet in a bobbin. These method and apparatus may be capable to increase the overall production rate of the production line.

In a first aspect, the invention relates to a method to remove an adhesive label from a bobbin, the bobbin including an end portion and an outer surface, the method including: providing a bobbin of a coiled sheet closed by an adhesive label positioned on top of the end portion of the coiled sheet to attach the same to the outer surface of the bobbin; locating the adhesive label; applying a sucking force to the location of the adhesive label so as to detach the adhesive label and the end portion of the coiled sheet from the bobbin; and cutting a part of the detached end portion including the adhesive label from the bobbin.

According to the invention, the adhesive label is detected and it is automatically removed from the bobbin by "sucking" the end portion of the sheet of material wound in the bobbin. The end portion carries the adhesive label which is attached thereon. Due to the fact that the end portion is sucked and thus detached from the rest of the bobbin, the end portion carrying the adhesive label can be removed by cutting it, so that also the adhesive label is removed at the same time.

As used herein, the term "sheet" denotes a flat element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters.

In a preferred embodiment, the sheet is a sheet of TCL or PLA.

In particular, the process to form TCL sheets commonly comprises a step in which tobacco dust and a binder are mixed to form a slurry. The slurry is then used to create a tobacco web. The so called cast leaf is produced for example by casting a viscous slurry onto a moving element. Alternatively, slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition may then be casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material may then be rolled in bobbins which needs to be unwound in order to be further processed, to be part for example of an aerosol-forming article, that is to be included in the aerosol-forming substrate of the aerosol-forming article.

In a "heat-not-burn" aerosol-generating article, an aerosol-forming substrate may be heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol forming material" denotes a material that is capable of releasing volatile compounds upon heating to generate an aerosol. Tobacco may be classed as an aerosol forming material, particularly a sheet of homogenized tobacco comprising an aerosol former. An aerosol forming substrate may comprise or consist of an aerosol forming material.

The homogenized tobacco sheet generally includes, in addition to the tobacco, a binder and an aerosol-former. This composition leads to a sheet which is "sticky", that is, it glues to adjacent objects, and at the same time it is rather fragile having a relatively low tensile strength.

The present invention may be especially adapted for bobbins made of homogenized tobacco material as defined above, however it can be applied as well in any process wherein a sheet, preferably having similar characteristics to a sheet of homogenized tobacco material, needs to be unwound from a bobbin.

The bobbin shape can be any. It can have a substantially cylindrical shape; however, an oval or anyhow deformed shape, such as a bobbin with bulges deforming an underlying cylindrical shape, does not hinder the application of the teaching of the invention.

The bobbin to be unwound is "closed" by means of an adhesive label.

In order to unwind such a bobbin, first of the entire adhesive label needs to be removed.

The adhesive label is positioned on top of an end portion of the bobbin in order to block movements of the same, that is, the adhesive label is positioned between the end portion and the remaining of the outer surface of the bobbin, so that the end portion is attached to the outer surface of the bobbin by means of the adhesive label.

In addition to the "gluing function", the adhesive label may include information written on itself regarding characteristics of the bobbin and the sheet of material coiled therein. The information can be written in any known way, for example as a bar code or in a RFID attached to the adhesive label. Further, also a serial number of the bobbin can be written in the adhesive label.

According to the invention, the position of the adhesive label on the outer surface of the bobbin is determined. The identification of the position of the adhesive label may be made by any known sensor, for example by an optical sensor, which may identify the presence of the adhesive label on the surface of the bobbin.

In order to remove the adhesive label, taking into consideration the possible fragility and stickiness of the sheet wound in the bobbin, according to the invention it is preferred to, as soon as the location of the adhesive label is identified, handle the sheet relatively "gently". For this purpose, the end portion of the sheet is sucked. Preferably, there is no mechanical gripping of the end portion of the bobbin, which might cause damages to the sheet; air sucking is used to lift it.

When the end portion of the sheet including the adhesive label is detached from the rest of the bobbin, the end portion is cut and the adhesive label consequently removed. The detachment is due to the sucking force and in this way the end portion of the sheet can be lifted from the remaining of the bobbin.

An effective label removal is therefore performed, which takes into account the characteristics of the sheet of material. Advantageously, the adhesive label is automatically removed together with the detached end portion of the coiled sheet, so that the bobbin is ready to be unwound.

Preferably, the method includes rotating the bobbin in an unwinding direction; and locating the adhesive label while rotating. In order to locate the adhesive label, it is preferred to keep the sensor fixed in a location and rotate the bobbin, so that the whole outer surface of the bobbin can be sensed by the sensor and the position of the adhesive label correspondingly determined. The apparatus on which the bobbin is located and by which the adhesive label is removed is preferably the same apparatus used for unwinding. Due to this, a rotation of the bobbin is already provided for and there is no need to modify the apparatus to add this function.

Preferably, locating the adhesive label includes partially lifting the adhesive label from the outer surface of the bobbin. In order to detach the end portion of the bobbin from the remaining of the bobbin, it is preferred that a not too strong suction force is applied, because too strong suction forces may tear the sheet of material. Therefore, it is preferred to partially detach or lift the adhesive label from the outer surface of the bobbin, so that the sucking force needed for the removal of the end portion, and thus of the adhesive label, from the outer surface is reduced. The detachment can be operated by means of a "peeling element" positioned so as to lift the adhesive label from the outer surface of the bobbin. The peeling element may be a flat element lifting a part of the adhesive label by means of one of its edges or tip.

More preferably, the method of the present invention includes: activating a sensor for adhesive label location by means of the lifted part of the adhesive label. Advantageously, the adhesive label is easily located, in particular by the sensor, by using a "flap" formed by the partially detached adhesive label as sensor's trigger. There is no need of an additional trigger for the sensor, the "flap" formed by the partially detached adhesive label assures the sensor response.

Preferably, the method of the present invention includes: reversing the rotation of the bobbin after locating the adhesive label. The adhesive label is attached to a bobbin with a first part attached to the end portion of the sheet and with a second part attached to the outer surface of the bobbin. In order to lift a portion of the adhesive label, so that it partially detaches from the outer surface of the bobbin and remains attached to the end portion of the sheet, the bobbin is preferably first rotated in an unwinding direction, so that the second part of the adhesive label is in front or upstream during the rotation. In this way, the second part of the label attached to the outer surface of the bobbin may touch the "peeling element" first and be partially detached from the outer surface itself. After the "peeling" is performed, the bobbin is then rotated in the opposite direction to move the adhesive label away from the peeling element. In this way, the end portion of the coiled sheet with the partially detached adhesive label is taken back to a specific location.

Preferably, applying a sucking force includes: sucking the adhesive label and the end portion of the coiled sheet attached thereto so that they lie against a sucking surface. The sucking is performed and consequently the end portion is detached from the bobbin. The end portion, by means of the sucking force, is in abutment to a surface, called sucking surface, where the end portion is kept for further processing. Preferably, the sucking surface is also the surface from which the sucking force is exerted. More preferably, the sucking surface is movable. Preferably, as soon as the end portion of the sheet is attached to it by means of the sucking force, the surface can be shifted together with the end portion, to move it to different locations so as to perform further possible processing steps.

More preferably, cutting a part of the detached portion includes: positioning a groove formed on said sucking surface at an end of the adhesive label attached to the end portion of the coiled sheet; and sliding a blade into the groove so as to cut the part of the end portion of the coiled sheet including the adhesive label from the bobbin. Advantageously, the groove formed in the sucking surface where the end portion is in abutment allows that the blade cuts a part of the end portion of the coiled sheet without damaging the surface itself and in addition cutting the end portion while the end portion is in abutment to the surface allows a precise cutting. Preferably, the method of the present invention includes: touching the outer surface of the bobbin with a flat element; and lifting the adhesive label by means of the flat element while rotating the bobbin. The flat element is preferably the "peeling element" which helps to lift the adhesive label, at least partially, from the outer surface of the bobbin so that the detachment of the end portion of the sheet does not require a very strong sucking force.

Preferably, applying a sucking force includes: putting a sucking surface in contact with the outer surface of the bobbin; sucking the adhesive label and the end portion of the coiled sheet by means of the sucking surface. Preferably, the sucking force is exerted from a surface, where for example a plurality of holes is formed and air is drawn into the holes. In order to "gently" lift the end portion of the bobbin, preferably first the sucking surface is put in contact with the end portion and then, by moving the sucking surface, the end portion is detached from the bobbin. Indeed, the end portion of the bobbin is kept in abutment to the sucking surface by the sucking force and moves together with the sucking surface.

Preferably, the method of the present invention includes: reading information contained in the adhesive label; and determining the presence of an error based on the read information. Information present in the adhesive label may be important for the correct processing of the bobbin. For example, in case the information contained in the adhesive label and read according to the invention indicates that the bobbin is not the correct or desired one, a signal is triggered so that the bobbin may be replaced.

According to a second aspect thereof, the invention relates to an apparatus to detach an adhesive label from an end portion of a coiled sheet in a bobbin, the adhesive label being located between the end portion and an outer surface of the bobbin, the apparatus including: a rotatable hub adapted to be inserted into a central hole of the bobbin; a position sensor adapted to sense the presence of the adhesive label on the outer surface of the bobbin; a suction device adapted to suck the adhesive label and the end portion of the coiled sheet to detach the same from the bobbin; a blade adapted to cut the end portion of the coiled sheet containing the adhesive label when the suction device is sucking the adhesive label and the end portion of the coiled sheet to detach the same from the bobbin.

Advantages of such an apparatus have been already discussed with reference to the first aspect of the invention and are not herewith repeated.

Preferably, the suction device is movable towards and away from the outer surface of the bobbin. In this movement, the suction device is attached to the end portion of the bobbin and moves together with it.

More preferably, the suction device includes a first and a second end, the position sensor being positioned at the first end of the suction device and being rotatable around a pivot point at the first end. The position sensor is positioned so that sensing the presence of the label is as easy as possible. Therefore, the possibility of rotating and moving the position sensor is desired in order to locate the adhesive label in a plurality of different positions on the bobbin.

Preferably, the apparatus includes a diameter sensor adapted to determine the diameter of the bobbin. The diameter of the bobbin is important information in order to move the suction device correctly. The suction device preferably is put into contact with the outer surface of the bobbin, and the location of the outer surface depends on the diameter of the bobbin.

Preferably, the suction device includes a sucking surface having a groove and the blade is adapted to translate within said groove. Advantageously, the groove allows that the blade cuts the end portion of the coiled sheet without damaging the sucking surface.

Preferably, the apparatus includes a flat element movable towards and away from the outer surface of the bobbin, the flat element being adapted to lift a portion of the adhesive label while the bobbin is rotating.

More preferably, the apparatus includes a linear actuator adapted to move the flat element towards and away from the bobbin. Due to the fact that the adhesive label is located not always in the same position, it is preferred that the flat element has also a flexible location.

Further advantages of the invention will become apparent from the detailed description thereof with no-limiting reference to the appended drawings.

Figure 1:
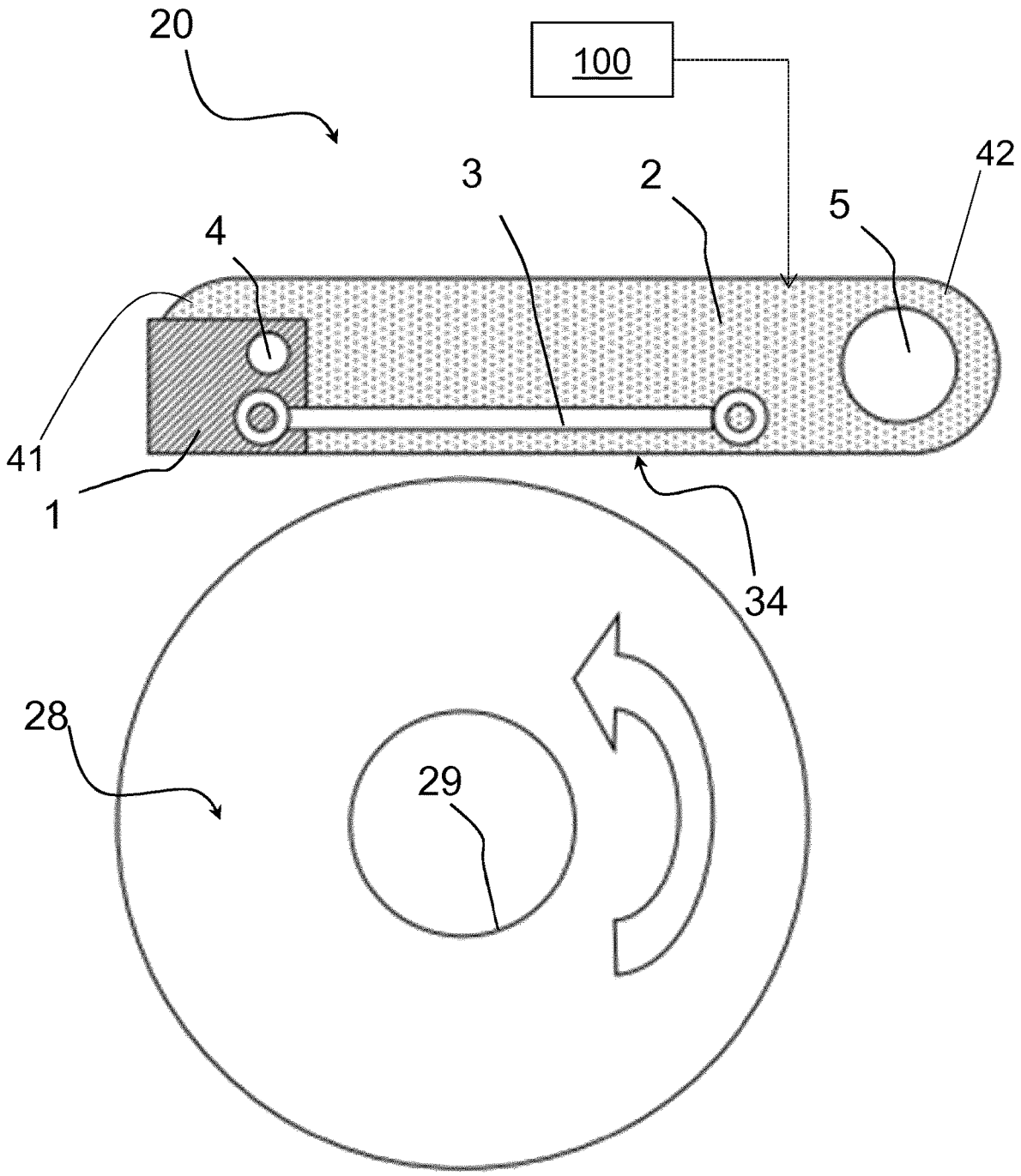
FIG. 1 is a schematic lateral view of an apparatus according to the invention for detaching an adhesive label from an end portion of a coiled sheet in a bobbin (shown), in a first operative condition.

With reference to the figures, an apparatus to detach an adhesive label 22 (visible in FIGS. 6 and 10) according to the present invention is represented and indicated with reference number 20.

The adhesive label 22 is detached from an end portion 24 of a coiled sheet 26 in a bobbin 28 (FIG. 6), already provided and manufactured in any known way. The bobbin 28 is formed by the coiled sheet 26 of material and defines an inner central hole 29, an outer surface 25 and the end portion 24.

The bobbin 28 shown in the figures has a round, for example cylindrical, shape. However, the invention works with any bobbins even when the bobbins do not have a round shape. The adhesive label 22 is located between the end portion 24 and the outer surface 25 of the bobbin 28.

Figure 2:
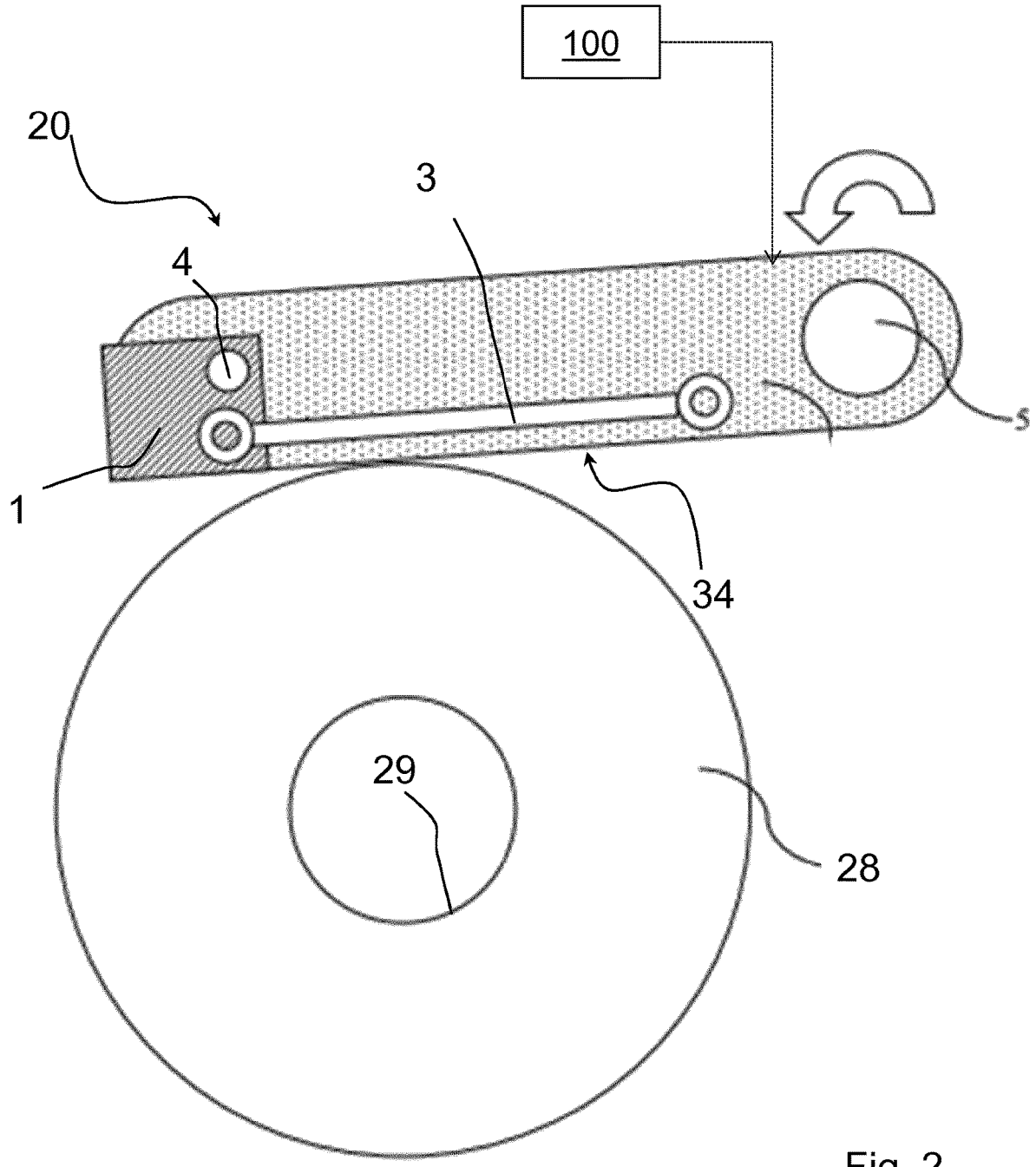
FIG. 2 is a schematic lateral view of the apparatus of FIG. 1, in a second operative condition.

With initial reference to FIGS. 1 and 2, the apparatus 20 comprises a rotatable hub 30 where the bobbin 28 is placed. The rotatable hub 30 is adapted to be inserted into the central hole 29 of the bobbin 28.

The apparatus 20 also includes a position sensor 32, a suction device 34 and a blade 36.

The position sensor 32 is adapted to sense the presence of the adhesive label 22 on the outer surface 25 of the bobbin 28.

The suction device 34 is adapted to suck the adhesive label 22 and the end portion 24 of the coiled sheet 26 to detach the same from the bobbin 28. The suction device 34 is movable towards and away from the outer surface 25 of the bobbin 28. The suction device 34 includes a sucking surface 35 having a groove 37. The sucking surface 35 includes a plurality of holes better described below.

The blade 36 is adapted to cut the end portion 24 of the coiled sheet 26 containing the adhesive label 22 when the suction device 34 is sucking the adhesive label 22 and the end portion 24 of the coiled sheet 26 to detach the same from the bobbin 28. The blade 36 is adapted to translate within the groove 37.

The position sensor 32 is positioned at one end 35 of the suction device 34 and it is rotatable around a pivot point 4 at the one end 35.

The apparatus further includes a flat element 8 (or substantially flat element), which is movable towards and away from the outer surface 25 of the bobbin 28. The flat element 8 is adapted to lift a portion of the adhesive label 22 while the bobbin 28 is rotating, so as to actuate the position sensor 32. A linear actuator 3 is adapted to move the flat element 8 towards and away the bobbin 28. The linear actuator is connected to the suction device and the flat element is located in proximity of the position sensor 32 at the same end of the suction device.

The apparatus 20 further includes a diameter sensor (not shown in the figures) which is adapted to determine the diameter of the bobbin 28.

In a preferred embodiment, the apparatus 20 has the overall architecture illustrated in FIGS. 1-4.

The apparatus includes the suction device 34. The suction device 34 includes an elongated conveying belt 40, forming an oval loop, with air suction effect to grab the adhesive label 22 as well as the end portion 24 of the coiled sheet 26 of the bobbin 28 attached to it. The conveyor belt includes the sucking surface 35 as a portion of its loop-shaped outer surface. The conveyor belt 40 is movable, that is, the sucking surface 35 may face the outer surface of the bobbin or can be opposite to it.

The conveying belt 40—in order to provide for the suction effect—has an air system and vacuum through holes 52 through the belt 40 allowing the outside air to be sucked by the air system, so that it can create a suction effect to an outside material. Preferably, the holes are formed at the sucking surface 35. The conveying belt 40 is specially designed using specific materials for adequate adhesion and enabling effective vacuum through holes 52.

The conveying belt 40 includes also a linear groove 37 formed on the sucking surface 35. The vacuum through holes 52 of the conveying belt 40 are before and after the groove 37.

Figure 12:
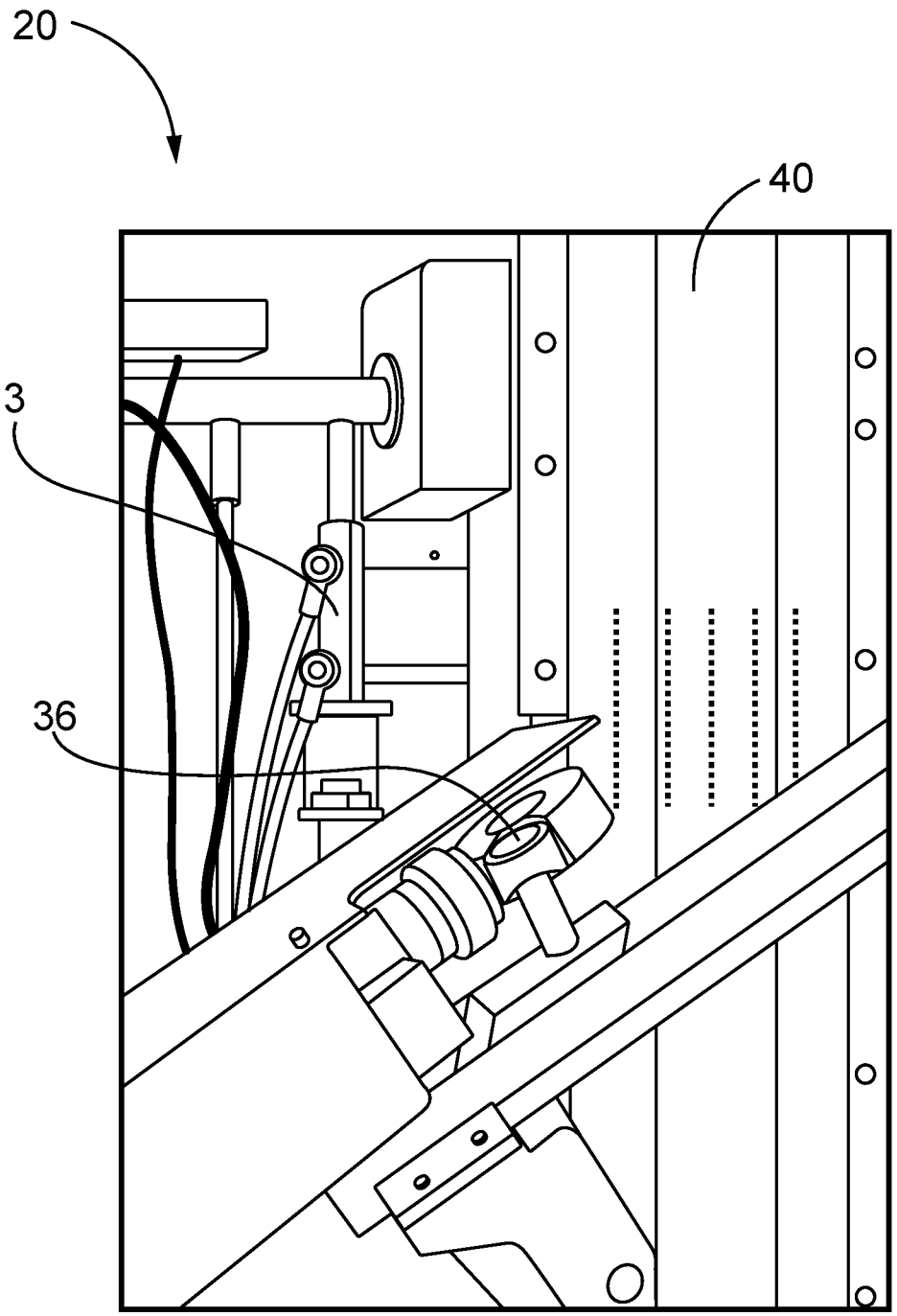
FIG. 12 is a schematic perspective view of the apparatus of FIG. 1, taken from above.

As shown in FIG. 12, the suction device 34 includes also the blade 36, which is for instance a motorized rolling knife. The blade is positioned and mounted in relationship with the conveyor belt 40 in such a way that can slide within the groove 37. This rolling knife 36 is rolling on the sucking surface 35 of the conveyor belt 40 and is positioned so that the linear groove 37 can be aligned with the linear trajectory of the rolling knife 36. Further, when the groove 37 of the belt 40 is aligned with the trajectory of the knife 36, the knife 36 can run into the groove 37 and cut a material that is stuck and hold on the air-suction conveying belt 40, as detailed below.

The suction device 34 further includes a label-reader device (not depicted in the drawings) to read the information contained in the adhesive label. Such label reader device could be a code bar reader.

The suction device 34, and more specifically the elongated conveyor belt 40, includes a first and a second distal end 41 and 42. The apparatus 20 further includes a label catching part 1 attached to the first end 41 of the suction device 34. The attachment of the label catching part 1 to the distal end 31 is such that the label catching part 1 can rotate around a pivot point 4 at the first distal end 41 of the suction device 34. The label catching part 1 includes the flat element 8, which—during a phase of the method of the invention—is so positioned that runs on the outer surface 25 of the bobbin 28 and partially lifts the adhesive label 22, and the position sensor 32 to detect when the adhesive label 22 has been partially lifted. More than one position sensor 32 can be provided. The position sensor could be a proximity sensor. In a preferred embodiment, the position sensor 32 includes an optical sensor. For instance, the optical sensor could include a laser emitting diode coupled with a photosensitive sensor. The label catching part 1 is partially facing the outer surface 25 of the bobbin 28 when in use. The position of the label catching part 1 with respect to the suction device 34, and in particular conveyor belt 40, can be varied, by means of the linear actuator 3, which is connected with one end to the label catching part 1 and with one opposite end to the conveyor belt 40. Changing the length of the linear actuator 3 therefore forces the label catching part 1 to vary an angle formed with the conveyor belt 40. The position of the label catching part 1 in respect of the bobbin 28 can be adjusted adjusting the length of the linear actuator 3, so that the flat element 8 mounted on the label catching part can be positioned tangentially to the outer surface 25 of the bobbin 28.

Figure 7:
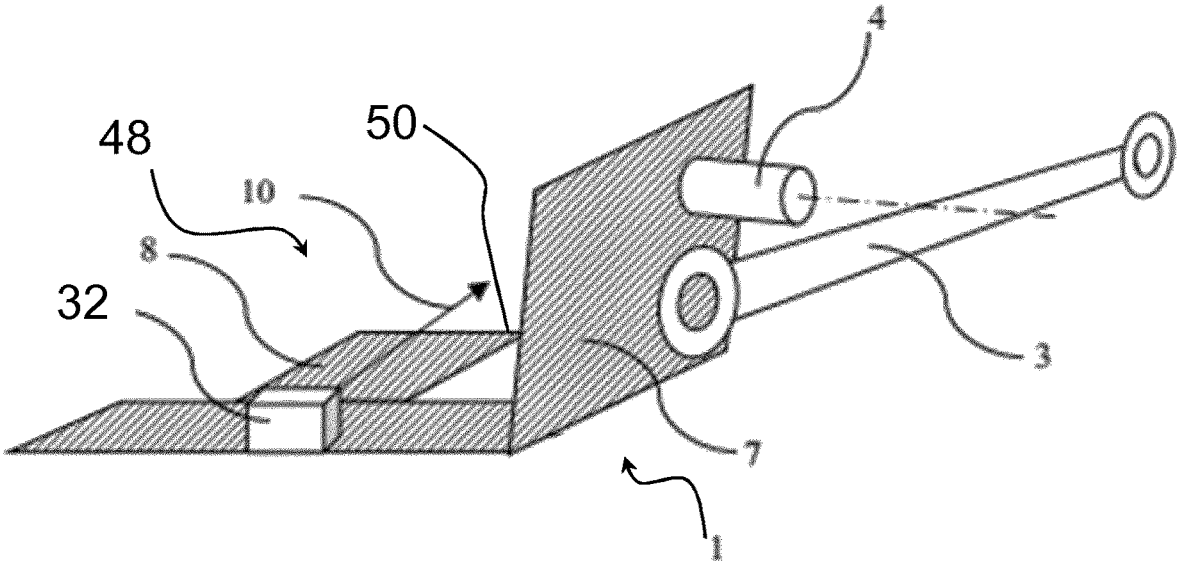
FIG. 7 is a schematic perspective view of a further portion (position sensor) of the apparatus of FIG. 1.
Figure 8:
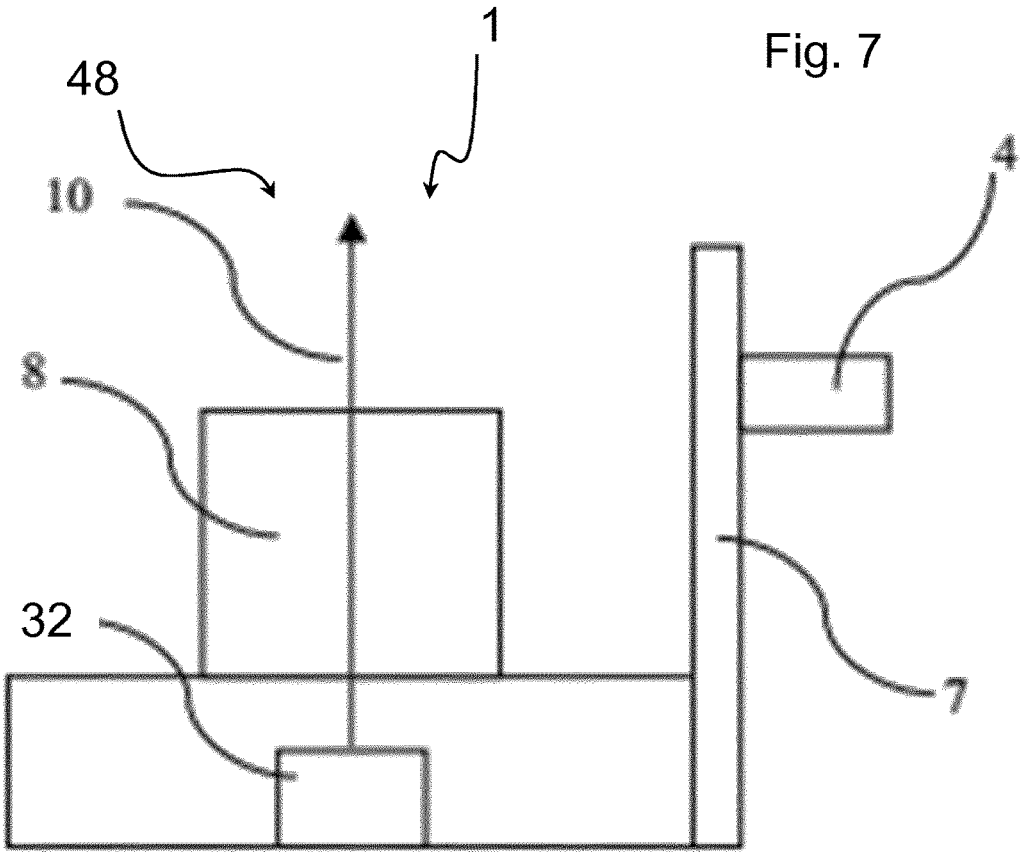
FIG. 8 is a schematic perspective view of the further portion of FIG. 7.
Figure 9:
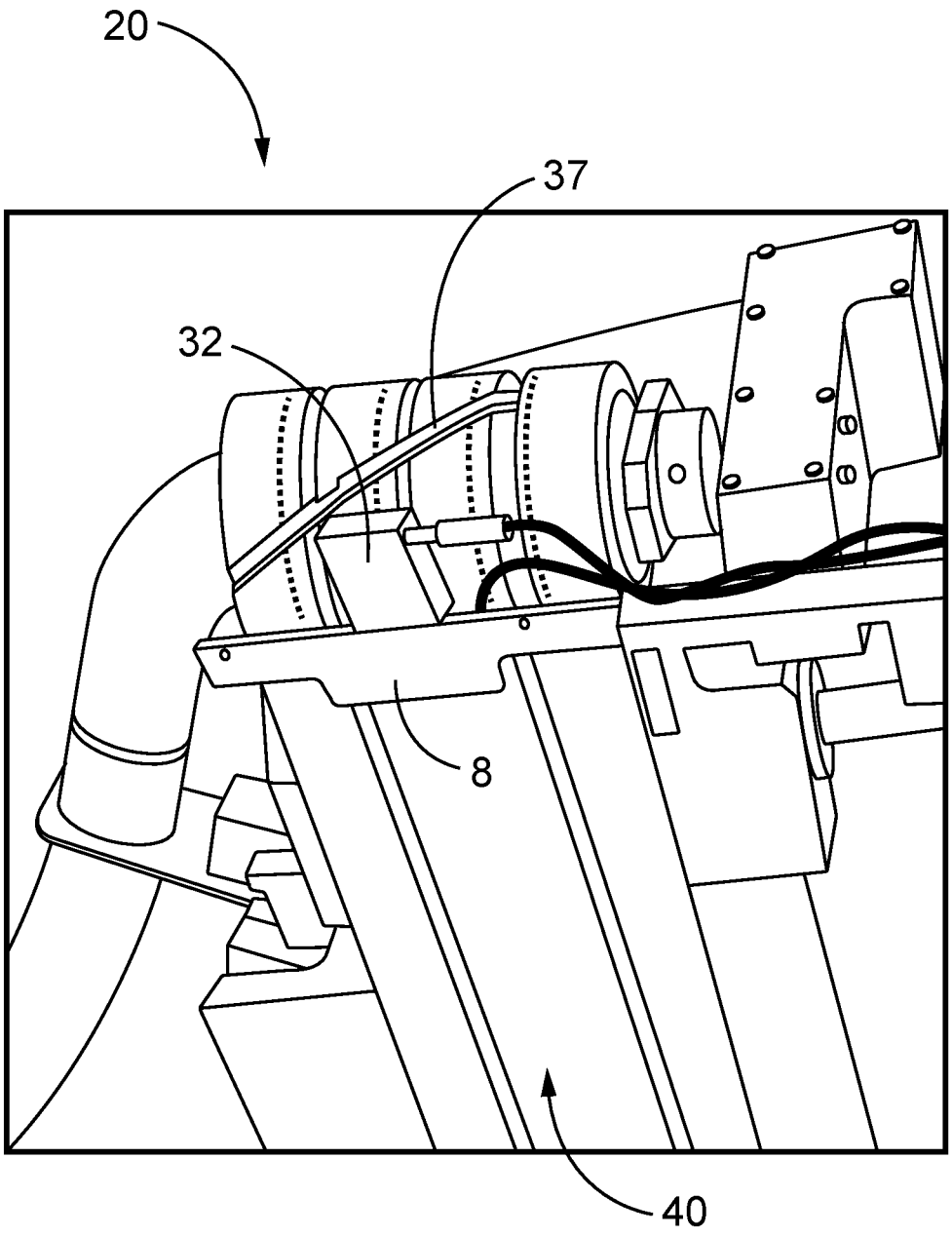
FIG. 9 is a schematic perspective view of the apparatus of FIG. 1, taken from below.

As shown in more details in FIGS. 7-10, the label catching part 1 has a hand portion 48 and the position sensor 32. As shown in FIGS. 7 and 8, the hand part 48 includes a side structure 7 upon which the linear actuator 3 is attached, and the substantially flat element 8 which preferably has a T shape. The substantially flat element 8 is coplanar with the sucking surface 35 of the conveyor belt 40 when the linear actuator 3 is at its highest length. The flat element 8 further includes a tip 50 which is adapted to enter into contact with the adhesive label and detach a portion of it, as detailed below. The position sensor 32 is preferably positioned so that the line of sight 10 of the optical sensor 32 is in the plane of the substantially flat element 8 and points toward the tip 50 of the substantially flat element 8.

The suction device 34 may change its position, that is, the suction device is not stationary. In order to change position, the apparatus 20 includes a motorized axis 5. The motorized axis 5 is located at the second distal end 42 of the suction device 34 to change its angular position. The conveyor belt 40 therefore can moves towards or away from the bobbin. In this way, the conveyor belt 40 can be brought into contact with the bobbin, so that it can be tangential with one of its surfaces to the outer surface 25 of the bobbin 28. The conveyor belt preferably enters into contact with the bobbin by means of the sucking surface. The sucking surface can be then moved from a position facing the bobbin to a different position.

Further, the apparatus 20 includes a control system 100. The control system (schematically depicted in FIGS. 1-3) receives the information from the position sensor 32 as well as information to the rotatable hub 30 and the diameter sensor (not shown); it commands accordingly the suction device 34 and the motorized axis 5, the label catching part 1, and it sends information and commands to the hub 30 so that it adjusts the rotation direction and speed of the bobbin 28.

The control system 100 preferably commands the apparatus 20 in the following steps according to the method of the invention, so as to remove the adhesive label 22 put on the bobbin 28.

Figure 6:
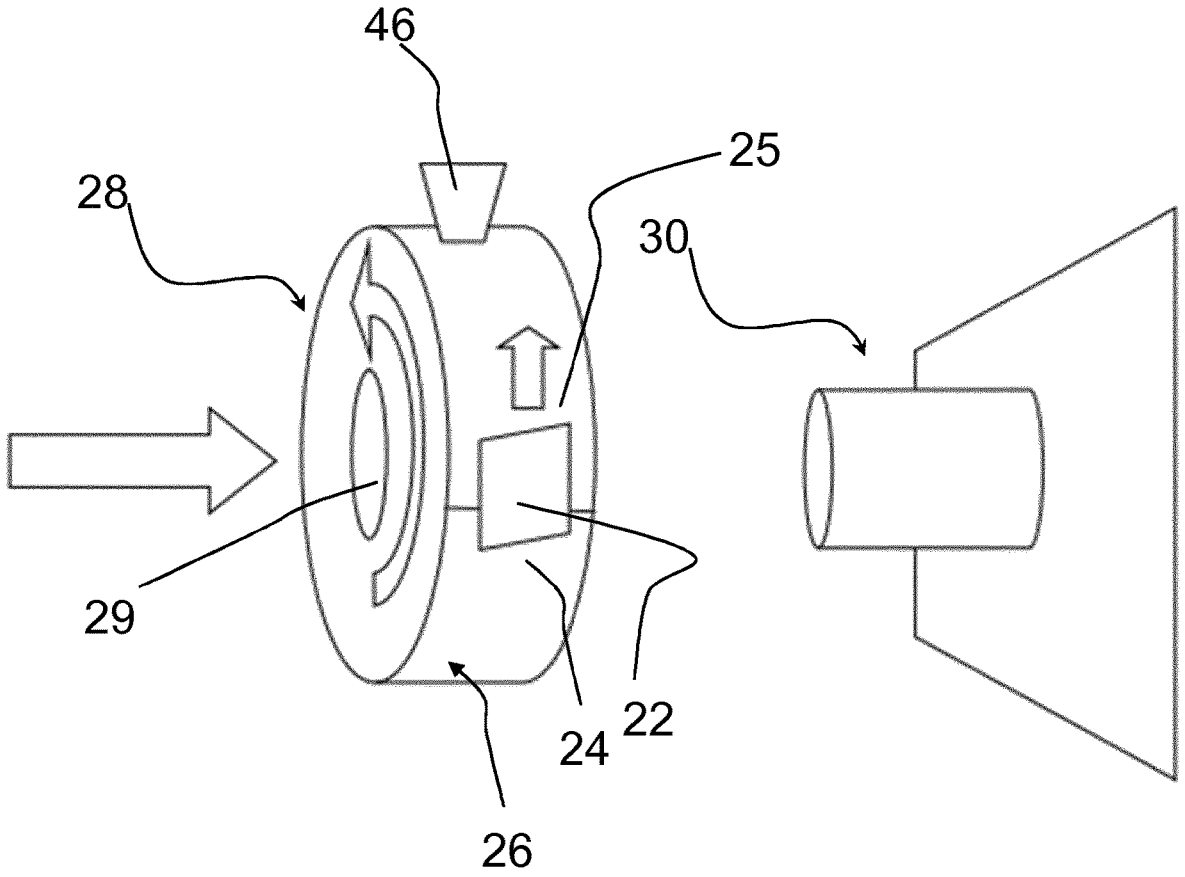
FIG. 6 is a schematic perspective view of a portion (rotatable hub) of the apparatus of FIG. 1 and a bobbin.

The bobbin 28 is placed under the suction device 40 and it rotates around its hub 30. However, different configuration of the location of the suction device and hub are possible (for example the suction device can be positioned laterally with respect to the hub). The bobbin 28 is rotated in the unwinding direction. It is pointed out that, for unwinding correctly the bobbin 28, the bobbin 28 is preferably put in the apparatus 20 with the coiled sheet 26 turning in the same direction than the rotation of the bobbin 28 during manufacturing. As shown in FIG. 6, the rotation direction herewith called "unwinding direction" is such that a general reference item 46, which is put at a fixed position on the outer surface 25 of the bobbin 28, will first encounter the adhesive label 22, then the end portion 24. That is, the direction of rotation called unwinding direction is such that a general item located on the outer surface of the bobbin first touches the part of the label 22 which is attached to the outer surface of the bobbin, and then the part of the label which is attached to the end portion of the sheet.

Using the motorized axis 5 and linear actuator 3, the label catching part 1 is initially positioned so that it is in contact with one of its elements with the outer surface 25 of the bobbin 28 and that the conveying belt 40 is not touching the bobbin 28.

In order to obtain such positioning, the movements are as follows.

The motorized axis 5 rotates the conveyor belt 40 either up or down, so that the conveyor belt 40 can vary its distance from the outer surface 25 of the bobbin 28. The needed angle to rotate the conveyor belt 40 up to a correct distance with the bobbin 28 is determined by the control system 100 from the data received from the diameter sensor. Other known proximity sensors or contact sensors could be used to adjust such position.

Further, the label catching part 1 can rotate freely around the axis 4 fixed to the treatment part 2, so that by reducing or increasing the length of the linear actuator 3, the label catching part 1 rotates around the axis 4.

Figure 3:
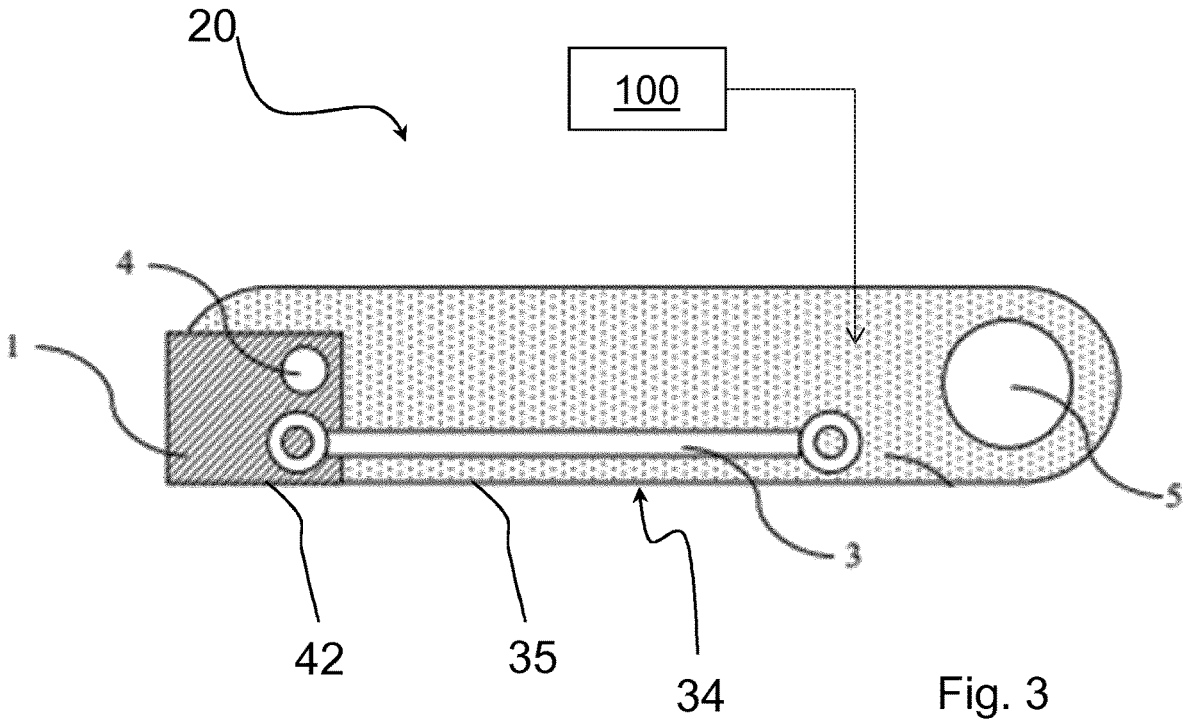
FIG. 3 is a schematic lateral view of the apparatus of FIG. 1, in the first operative condition.
Figure 4:
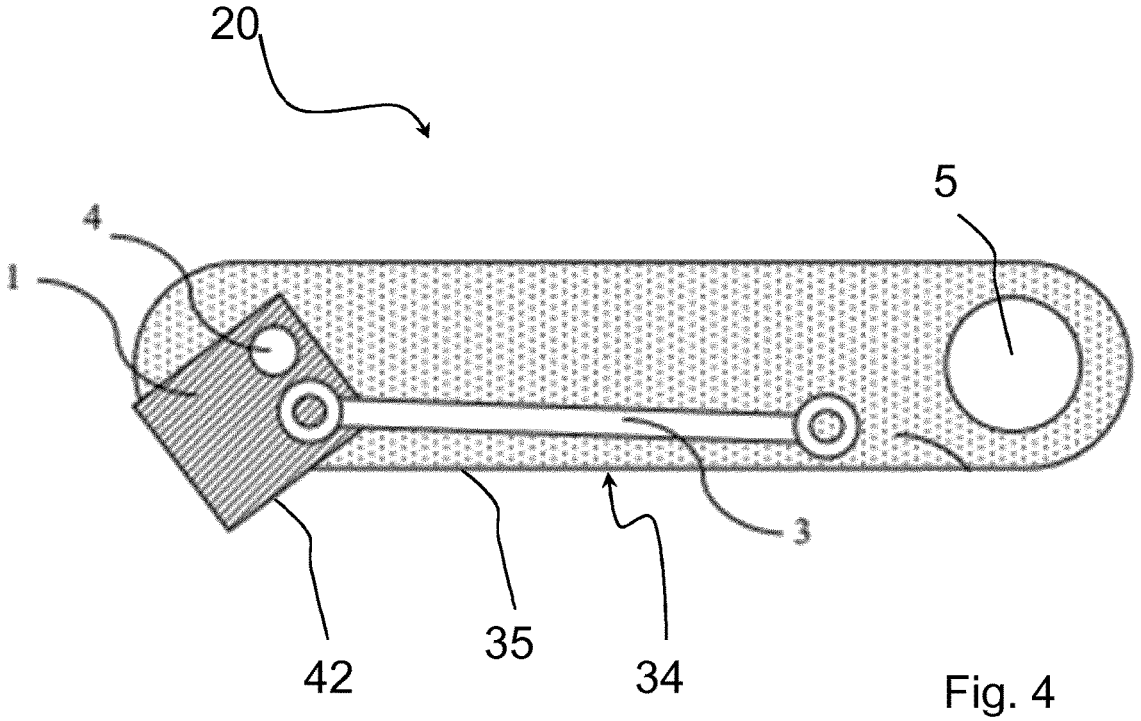
FIG. 4 is a schematic lateral view of the apparatus of FIG. 1, in a third operative condition.
Figure 5:
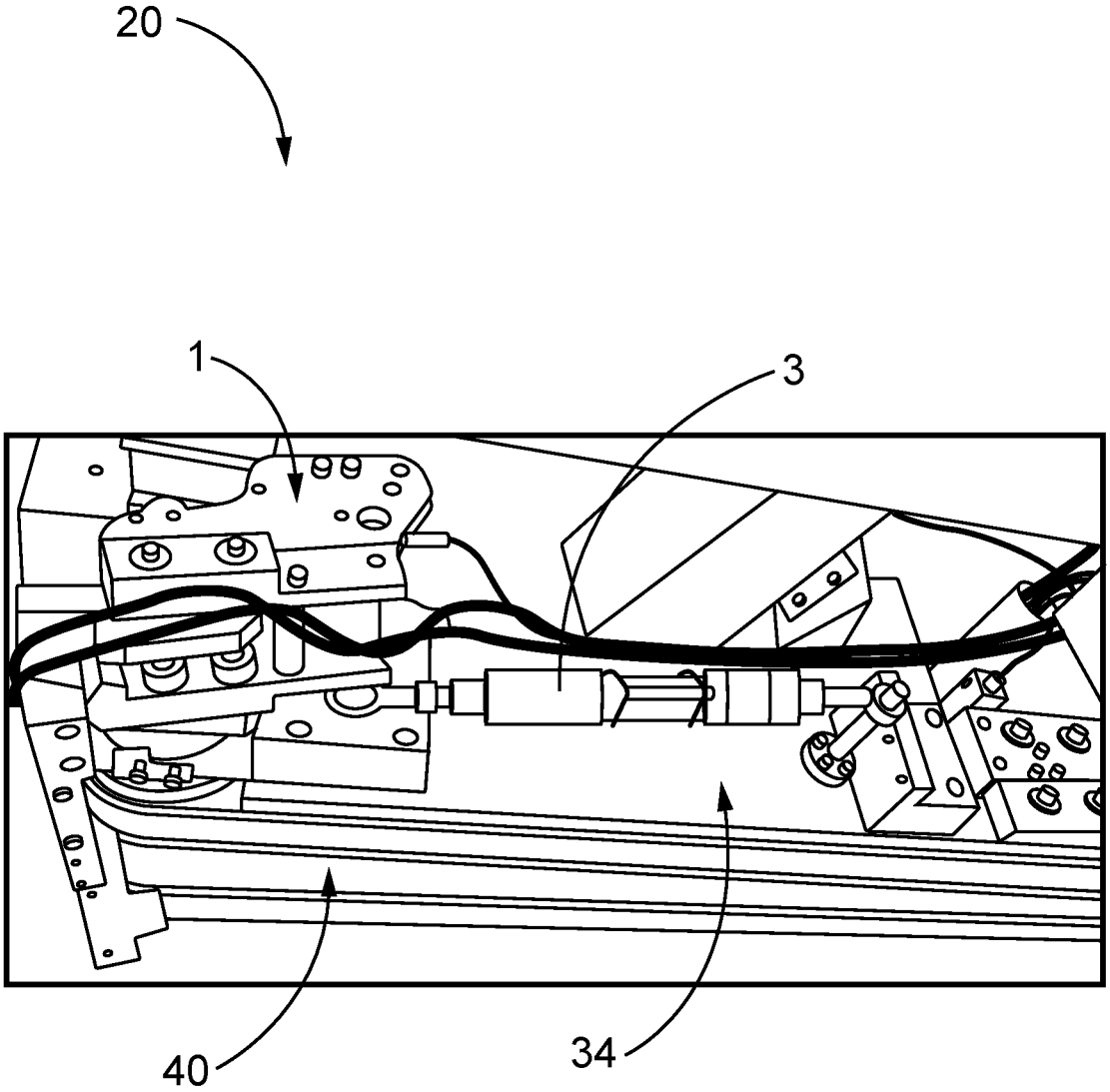
FIG. 5 is a schematic perspective view of the apparatus of FIG. 1.

FIGS. 3 and 4 illustrate the apparatus 20 with two positions of the label catching part 1 according to different lengths of the linear actuator 3.

In FIG. 3 the linear actuator 3 is at its longest length and a bottom surface 42 of the label catching part 1 is coplanar to sucking surface 35 of the conveyor belt 40. In FIG. 4 the linear actuator 3 is shorter than in FIG. 2, so that the label catching part 1 rotates counter-clockwise around the axis 4. The needed angle to rotate the label catching part 1 in order to obtain a contact of the label catching part 1 with the bobbin 28 is determined from the data from the diameter sensor, data which are received by the control system 100, as well as from the current position of the conveyor belt 40 (in particular the rotation angle of the motorized axis 5). Other known proximity sensors or contact sensors could be used to adjust such position. Using these two elements, the motorized axis 5 and linear actuator 3, the sucking surface 35 of the conveyor belt 40 can be positioned at the desired distance from the outer surface of the bobbin and the bottom surface 42 of the label catching part 1 can be tangentially touching the outer surface 25 of the bobbin 28.

More in detail, the control system 100 of the apparatus 20 rotates the label catching part 1, so that the tip 50 of the substantially flat element 8 enters into tangential contact with the outer surface 25 of the bobbin 28. The final positioning is so that the tip 50 of the substantially flat element 8 is then facing the direction opposite to the unwinding direction of the bobbin 28.

Then, the control system 100 commands the bobbin 28 into rotation in the unwinding direction (that is, the direction used during manufacturing), so that the tip 50 of the substantially flat element 8 "lightly scratches" along the outer surface 25 of the bobbin 28. When the tip 50 of the substantially flat element 8 encounters the adhesive label 22, it bumps against an edge of the adhesive label 22 attached to the outer surface of the bobbin, due to the direction of rotation. When the bobbin 28 carries on its rotation, the adhesive label 22 is pushed and progressively unstuck at least partially by the tip 50 of the substantially flat element 8. By doing so, the adhesive label 22 forms a "flap" which in turn is moved into the line of sight 10 (see FIGS. 7 and 8) of the position sensor 32 and triggers it (in the preferred embodiment, the light of the laser will be reflected on the adhesive label 22 and will be captured by the photosensitive sensor—not shown in the drawings).

In case the edge of the adhesive label 22 is too thin to be partially detached by the tip 50, the operator, when places the bobbin 28 on the hub 30, could unstick a little bit the edge of the adhesive label 22 (forming the "flap" manually) to help the apparatus 20 to remove the label completely and activate the position sensor 32. In this way, the position of the adhesive label 22 is detected.

Figure 10:
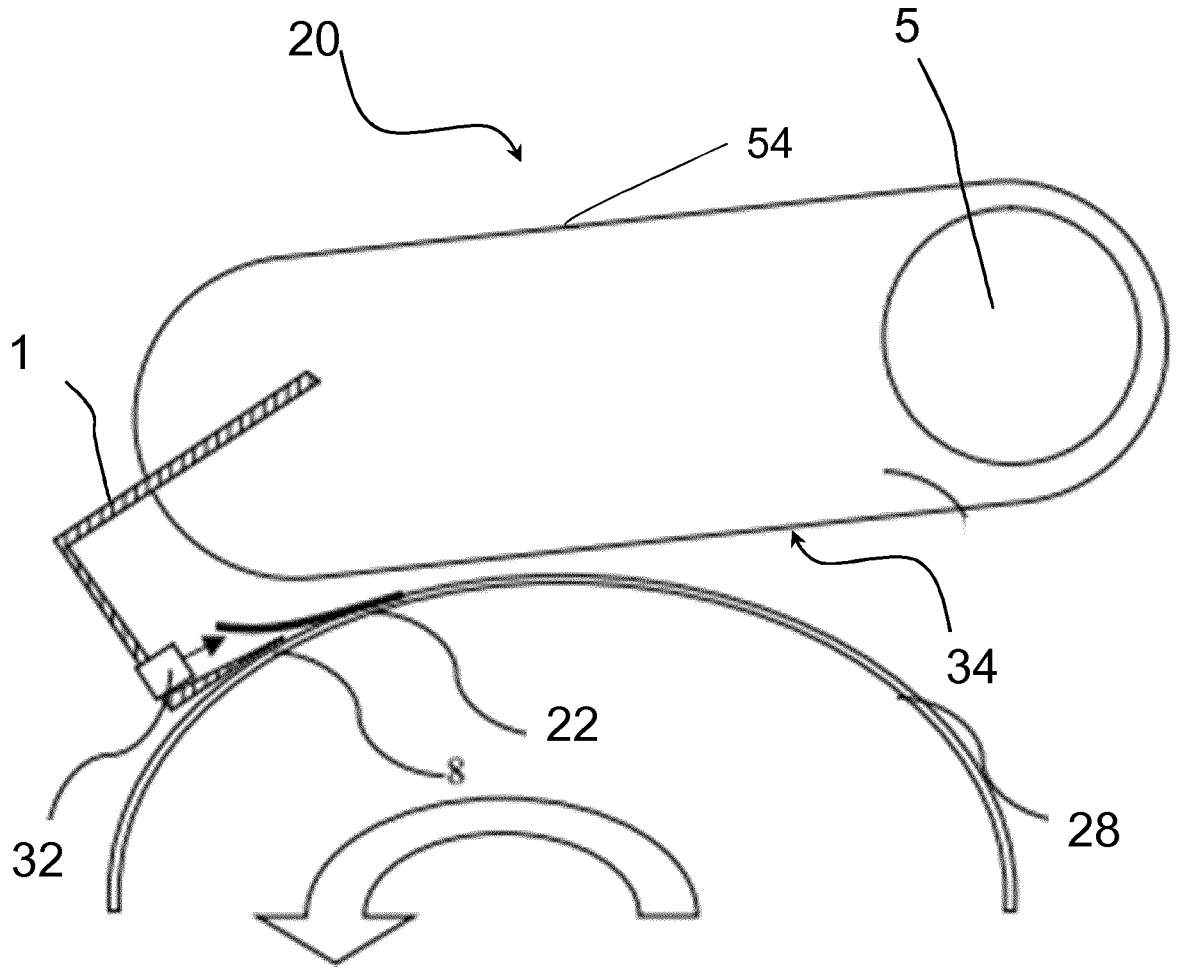
FIG. 10 is a schematic lateral section of the apparatus of FIG. 1, in a fourth operative condition.
Figure 11:
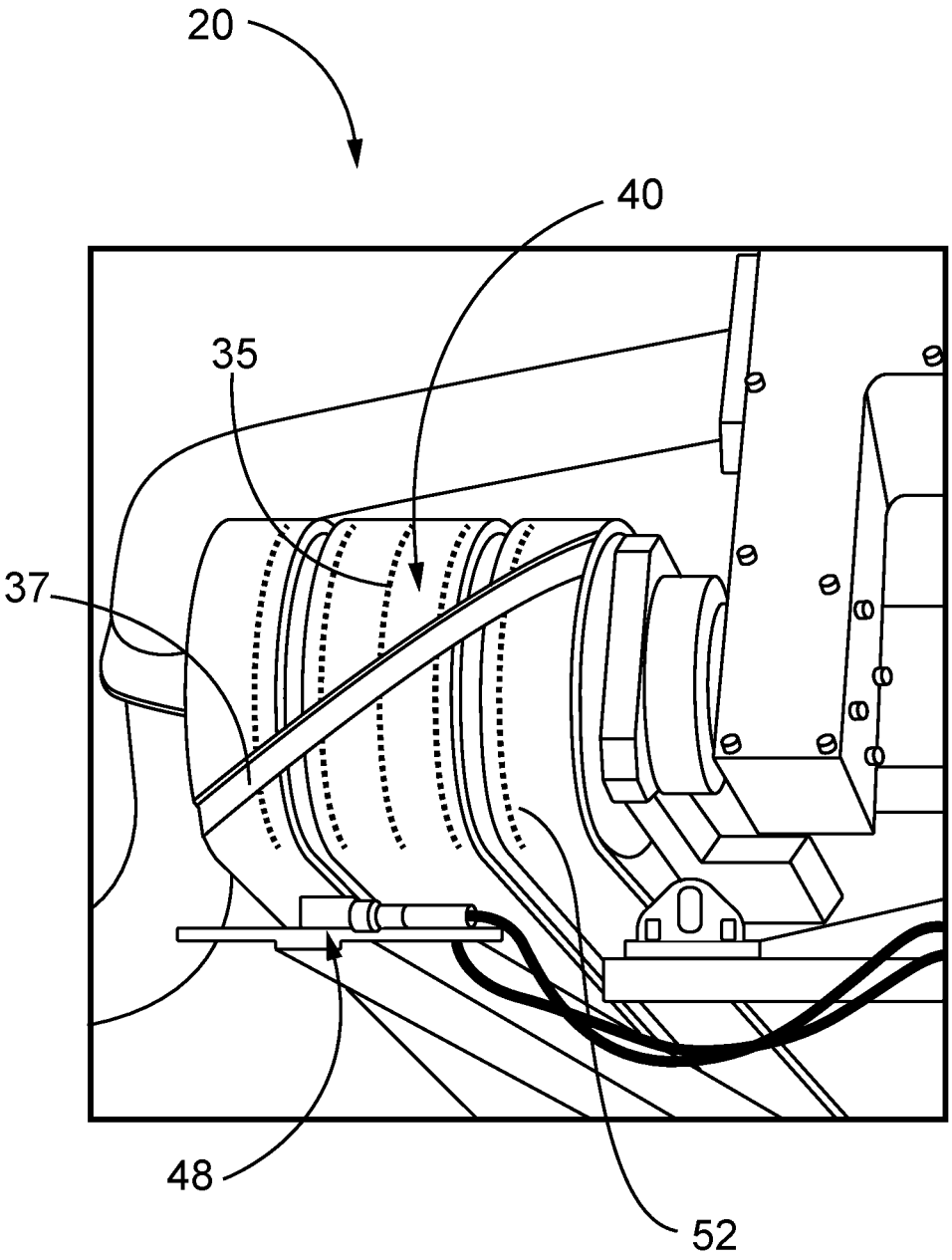
FIG. 11 is a schematic perspective view of the apparatus of FIG. 1, taken from a front side.

In FIG. 10, the substantially flat element 8 has been rotated so that it is in contact with the outer surface 25 of the bobbin 28 which rotates in the unwinding direction. The adhesive label 22 has been partially pushed by the tip 50 of the substantially flat element 8 and triggers the position sensor 32. At this step, the sucking surface 35 of conveyor belt 40 is still not in contact with the bobbin 28.

The control system 100, when receiving the signal of the position sensor 32 that the label position has been detected, sends a proper command to stop the rotation of the bobbin 28 and subsequently to rotate the bobbin 28 in the opposite direction. The rotation in the opposite direction, that is, the rotation in a direction opposite to the unwinding direction, is performed for an angle such that the adhesive label 22—the position of which is now known—is moved at a specific position under the conveyor belt 40, facing sucking surface 35. The exact rotational angle the bobbin 28 is to be moved is determined by the control system 100 which has information relative to the diameter of the bobbin 28 as well as to the distance between the tip 50 of the substantially flat element 8 and the targeted area of the sucking surface 35 of the conveyor belt 40.

The conveyor belt 40 is then moved so as to position the groove 37 before the position of the adhesive label 22. In the following, "before" means that in the unwinding direction, the label 22 is positioned downstream the groove 37. Preferably, in order to position the groove correctly, the approximate size of the adhesive label 22 is known.

The control system 100 also sends signals to move and adjust the suction device 34 as detailed below.

FIG. 2 illustrates the suction device 34 being put in contact with the bobbin 28 by the motorized axis 5.

In this position, using the motorized axis 5 of the suction device 34 so as to make the conveying belt 40 touch the bobbin 28, the linear groove 37 of the conveyor belt 40 is positioned just before the adhesive label 22.

The air suction force of the belt 40 is thus activated so that the adhesive label 22 and the end portion 24 of the bobbin 28 are lifted from the outer surface of the bobbin and get in abutment to the sucking surface 35 of the conveyor belt 40. The control system 100 may use measurements of air pressure variations to determine whether a material, such as the sheet of the bobbin, has been stuck by the air system to the conveyor belt 40. In this way it is possible to determine whether the application of the sucking force has properly removed the end portion of the bobbin from the outer surface of the bobbin.

Then, preferably, the conveyor belt 40, to which now the adhesive label 22 is in abutment, moves so that the adhesive label attached to the end portion of the sheet is transported to a top surface 54 of the conveyor belt 40. In other words sucking surface 35 initially facing bobbin 28, is shifted and becomes a top surface of the conveyor belt 40. This movement is done in coordination with a rotation of the bobbin 28 that releases the amount of coiled sheet 26 needed for the adhesive label 22 to go to the top surface 54.

In this position, the label reader device reads the adhesive label 22. In case the information read in the adhesive label matches the desired or expected information for the bobbin 28, then the removal of the adhesive label 22 proceeds as described below. Otherwise, the method of the invention is interrupted and the bobbin is changed. In this latter case, for example, the belt 40 goes in reverse movement as well as the bobbin 28, so that the adhesive label 22 goes back onto the bobbin 28, and a warning or alarm signal is triggered so that the bobbin 28 is replaced.

In a positive bobbin identification, when the information red in the label are the expected ones, the conveyor belt 40 is again moved so that the linear groove 37 is aligned with the rolling knife trajectory. The rolling knife 36 then cuts the coiled sheet 26 before the adhesive label 22. The adhesive label 22 is thus removed together with a part of the end portion of the sheet. A new end portion of the bobbin is thus formed, still indicated with 24 in the following.

The belt 40 is then again moved to bring back the end portion 24 on the bobbin surface. This is done in coordination with the reverse rotation of the bobbin 28. The exact amount of movement to be done by the belt 40 as well as by the bobbin 28 is known. The length of the movement is equal to the distance between the groove 37 and the contact point between the conveyor belt 40 and the outer surface of the bobbin 28.

When the new end portion 24 of the bobbin is again positioned above the outer surface of the bobbin, then the air suction performed by the sucking surface 35 of the conveyor belt is stopped to release the new end portion 24 of the bobbin 28. The unwinding of the bobbin can be thus start.

The invention claimed is:

1. A method to remove an adhesive label from a bobbin, the bobbin including an end portion and an outer surface, the method including:

providing a bobbin of a coiled sheet closed by an adhesive label positioned on top of the end portion of the coiled sheet to attach the same to the outer surface of the bobbin;

locating the adhesive label;

applying a sucking force to the location of the adhesive label so as to detach the adhesive label and the end portion of the coiled sheet from the bobbin; and cutting a part of the detached end portion including the adhesive label from the bobbin, wherein applying a sucking force includes:

sucking the adhesive label and the end portion of the coiled sheet attached thereto so that they lie against a sucking surface;

wherein cutting a part of the detached end portion includes:

positioning a groove formed on said sucking surface at an end of the adhesive label attached to the end portion of the coiled sheet; and sliding a blade into the groove so as to cut the part of the end portion of the coiled sheet including the adhesive label from the bobbin.

2. The method according to claim 1, including:

rotating the bobbin in an unwinding direction; and locating the adhesive label while rotating.

3. The method according to claim 2, including:

reversing the rotation of the bobbin after locating the adhesive label.

4. The method of claim 1, wherein locating the adhesive label includes:

partially lifting the adhesive label from the outer surface of the bobbin.

5. The method according to claim 4, including:

activating a sensor for adhesive label location.

6. The method according to claim 1, including:

touching the outer surface of the bobbin with a flat element;

lifting the adhesive label by the flat element while rotating the bobbin.

7. The method according to claim 1, wherein applying a sucking force includes:

putting a sucking surface in contact with the outer surface of the bobbin; and sucking the adhesive label and the end portion of the coiled sheet by the sucking surface.

8. An apparatus to detach an adhesive label from an end portion of a coiled sheet in a bobbin, the adhesive label being located between the end portion and an outer surface of the bobbin, the apparatus including:

a rotatable hub adapted to be inserted into a central hole of the bobbin;

a position sensor adapted to sense the presence of the adhesive label on the outer surface of the bobbin;

a suction device adapted to suck the adhesive label and the end portion of the coiled sheet to detach the same from the bobbin; and a blade adapted to cut the end portion of the coiled sheet containing the adhesive label when the suction device is sucking the adhesive label and the end portion of the coiled sheet to detach the same from the bobbin, wherein the suction device includes a sucking surface having a groove and wherein the blade is adapted to translate within said groove.

9. Apparatus according to claim 8, wherein the suction device is movable towards and away from the outer surface of the bobbin.

10. Apparatus according to claim 8, wherein the suction device has a first and a second end, and the position sensor is positioned at the first end of the suction device and it is rotatable around a pivot point at the first end.

11. Apparatus according to claim 8, including a diameter sensor adapted to determine a diameter of the bobbin.

12. Apparatus according to claim 8, including a flat element movable towards and away from the outer surface of the bobbin, the flat element being adapted to lift a portion of the adhesive label while the bobbin is rotating.

13. Apparatus according to claim 12, including a linear actuator adapted to move the flat element towards and away the bobbin.

* * * * *